United States Patent [19]

Kagami et al.

[11] Patent Number: 4,834,568

[45] Date of Patent: May 30, 1989

[54] PAPER FEEDING APPARATUS FOR PRINTER

[75] Inventors: Isao Kagami, Nagoya; Makoto Hasegawa, Kasugai, both of Japan

[73] Assignee: Brother Kogyo Kabushiki Kaisha, Aichi, Japan

[21] Appl. No.: 146,434

[22] Filed: Jan. 21, 1988

[30] Foreign Application Priority Data

Feb. 18, 1987 [JP] Japan ..... 62-22606

[51] Int. Cl.[4] ..... B41J 29/18

[52] U.S. Cl. ..... 400/707.1; 400/708

[58] Field of Search ..... 400/636, 636.1, 636.2, 400/636.3, 641, 708, 708.1, 703, 707.1; 271/110, 111, 113, 116, 235, 227, 265, 272, 256, 258, 255, 261

[56] References Cited

U.S. PATENT DOCUMENTS

| | | | |
|---|---|---|---|
| 4,268,021 | 5/1981 | Rutishauser et al. | 400/636.2 |
| 4,565,462 | 1/1986 | Yamamoto et al. | 400/708 X |

FOREIGN PATENT DOCUMENTS

| | | | |
|---|---|---|---|
| 45364 | 2/1982 | European Pat. Off. | 271/110 |
| 2716396 | 10/1978 | Fed. Rep. of Germany | 400/636 |
| 61587 | 4/1982 | Japan | 400/641 |
| 103861 | 6/1982 | Japan | 400/605 |
| 85978 | 5/1985 | Japan | 400/708 |

OTHER PUBLICATIONS

"Paper Feed Process Variations Compensated" IBM Technical Disclosure Bulletin, vol. 22, No. 12, 5/80 pp. 5272–5275.

*Primary Examiner*—Eugene H. Eickholt

*Attorney, Agent, or Firm*—Oliff & Berridge

[57] ABSTRACT

A paper feeding apparatus for a printer comprises a control means and a drive mechanism for feeding a sheet of paper to a predetermined printing position on the platen. The control means activates the drive mechanism for a predetermined period until a paper detective sensor near the platen detects a leading edge of the sheet. If the paper detective sensor detects no sheet after the predetermined period, a control means repeats the paper feed operation without requiring the operator to give a subsequent driving signal.

6 Claims, 8 Drawing Sheets

S114,S118 --- STEPPING MOTOR HAS ROTATED FOR 144 STEPS ?

PAPER FEEDING APPARATUS FOR PRINTER

BACKGROUND OF THE INVENTION

This invention relates to a paper feeding apparatus which feeds a sheet of paper automatically to the printing mechanism of the printer.

There is a conventional paper feeding apparatus, which feeds a sheet of paper from the paper feed tray by the rotation of the feed roller so that the sheet is set between the platen and the paper guide roller. If a paper detective sensor, provided adjacent to the platen, detects no paper, it gives an alarm lamp, an alarm sound and the like.

However, the raise of such an alarm does not cause the apparatus to repeat automatically the feed action. Therefore, the operator must give a driving signal to the apparatus again by pressing a key or the like after checking the paper condition on the paper feed tray, even when a sheet of paper is in such a position that another feed action could certainly feed a sheet to the printing position; for example, when the sheet has not reached the printing position yet because of the weak contact of paper with the paper feed roller or because of imperfect separation of curved sheets. As a result, it makes it complicated to operate the apparatus.

SUMMARY OF THE INVENTION

It is accordingly an object to provide a paper feeding apparatus having a paper detective sensor and control means which execute a subsequent paper feed operation when a sheet of paper is not detected by the sensor at a predetermined position, so that it considerably decreases the frequency in imperfect paper feed to the printing mechanism and accordingly makes it easier to handle the apparatus.

This object is attained by a sheet feeding control device for a printer comprising: a printing mechanism for printing on a sheet of paper on a platen; a plate for piling up the sheet thereon; a feed roller provided at a paper feeding side of the plate to rotate in a forward direction in contact with the sheet on the plate and sequentially feeding the sheet to the printing mechanism; a drive mechanism for rotating the feed roller; detection means for detecting that the sheet has reached a predetermined position of a sheet path and generating a signal representative thereof; control means for activating the drive mechanism to cause a feeding action during a predetermined time period, for stopping the feeding action in the presence of the signal from the detection means and for activating the drive mechanism to cause the feeding action again in the absence of the signal from the detection means.

The object is also attained by a sheet feeding control device for a printer comprising: a printing mechanism for printing on a sheet on a platen; a plate for piling up the sheet thereon; a feed roller provided at a sheet feeding side of the plate to rotate in forward and reverse directions in contact with the sheet on the plate and sequentially feeding the sheet to the printing mechanism; a drive mechanism for rotating the feed roller; detection means for detecting that the sheet has reached a predetermined position of a sheet path and generating a signal representative thereof; control means for activating the drive mechanism to cause a first forward feeding action followed by a reverse-and-forward feeding action for preventing a skew of the sheet and to stop the reverse-and-forward feeding action in the presence of the signal from the detection means and for activating the drive mechanism to cause a second forward feeding action and to repeat the reverse-and-forward feeding action for preventing the skew in the absence of said signal from the detection means.

BRIEF DESCRIPTION OF THE DRAWINGS

The invention will now be described with reference to the accompanying drawings, in which.

DETAILED DESCRIPTION OF THE PREFERRED EMBODIMENTS

A paper feeding apparatus for a printer embodying the present invention will be described hereinafter according to the drawings.

Figure 2:
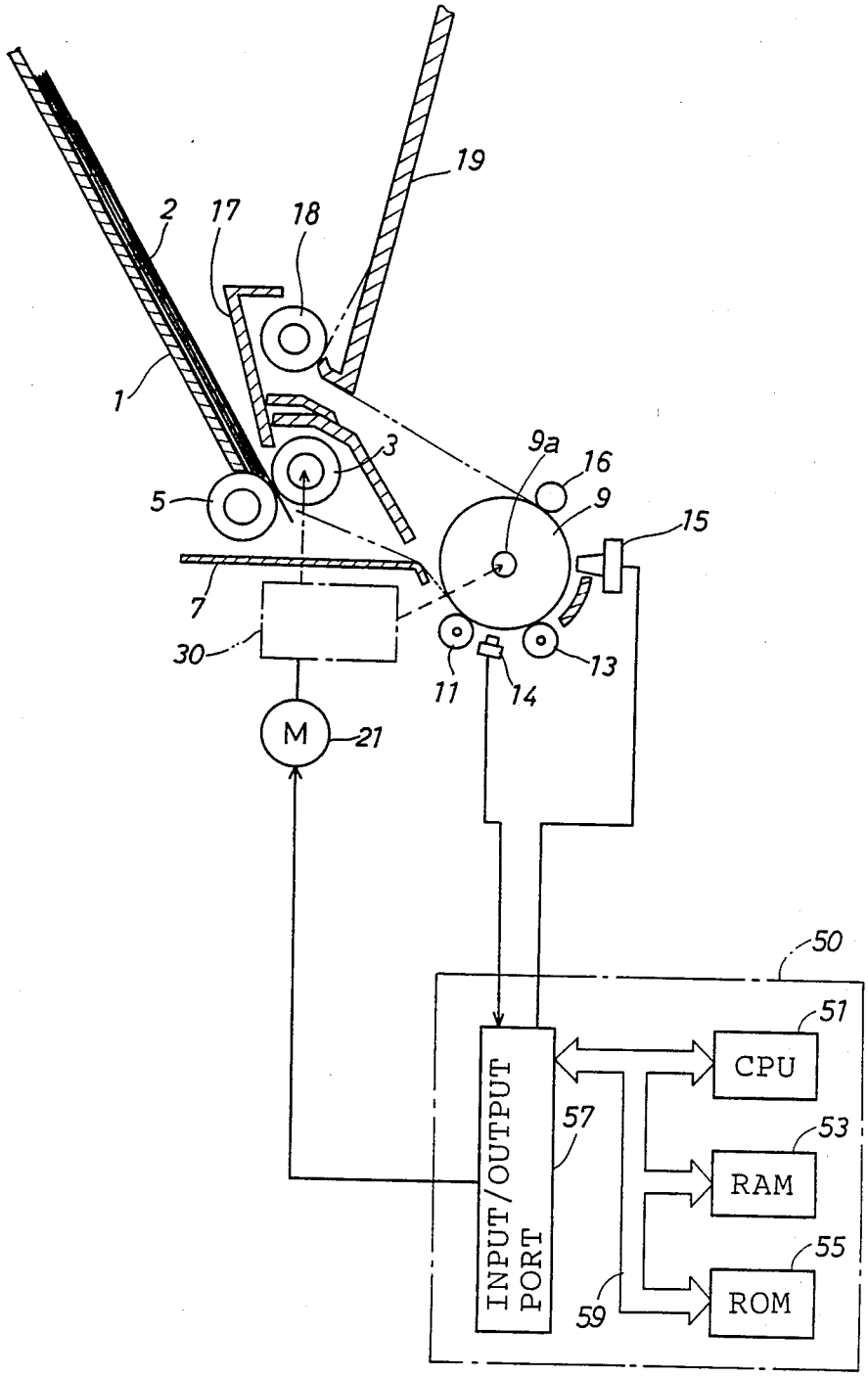
FIG. 2 is a schematic side view with a block diagram illustrating the paper feeding apparatus.

Referring to FIG. 2, a paper feed tray 1 is fixed on a printer case (not shown) for holding a pile of individual cut sheets 2. At the lower end of the paper feed tray 1, a paper feed roller 3 and a brake roller 5 are supported by both side boards of the printer case. On a paper path extending from the feed roller 3 and the brake roller 5, a guide member 7 is attached to the printer case, and a platen shaft 9*a* of a platen 9 is rotatably supported between the both side boards for operating as a driving roller. A rear paper guide roller 11 and a front paper guide roller 13 are provided in contact with the lower surface of the platen 9 so as to advance a sheet of paper 2 between the platen 9 and the rollers 11 and 13. A paper detective sensor 14 is disposed between the rollers 11 and 13 so as to output a predetermined electric signal upon detection of a leading edge of a sheet 2. In front of the platen 9, a print head 15 is disposed movably back and forth along the longitudinal direction of the platen 9. A paper bail roller 16 is disposed above the print head 15 so as to bring the sheet 2 into contact with the platen 9. A guide member 17 is provided on the paper path in such a manner that the sheet 2 moved from the platen 9 is discharged by a paper discharge roller 18 and then received by a paper stacker 19.

The paper feed roller 3 and the platen 9 are driven by a driving force of a stepping motor 21 for line feed (LF). The driving force is transmitted via a gear mechanism and an intermittent mechanism 30, shown in detail in FIG. 1.

The stepping motor 21 is controlled by an electronic control unit 50. The electronic control unit 50 as a control means comprises a well-known microcomputer; namely, a central processing unit (CPU) 51, a random access memory (RAM) 53, a read only memory (ROM) 55, an input/output port 57, and a common bus 59. The input/output port 57 converts an input/output signal from the external into a signal which can be manipulated by the CPU 51.

Figure 1:
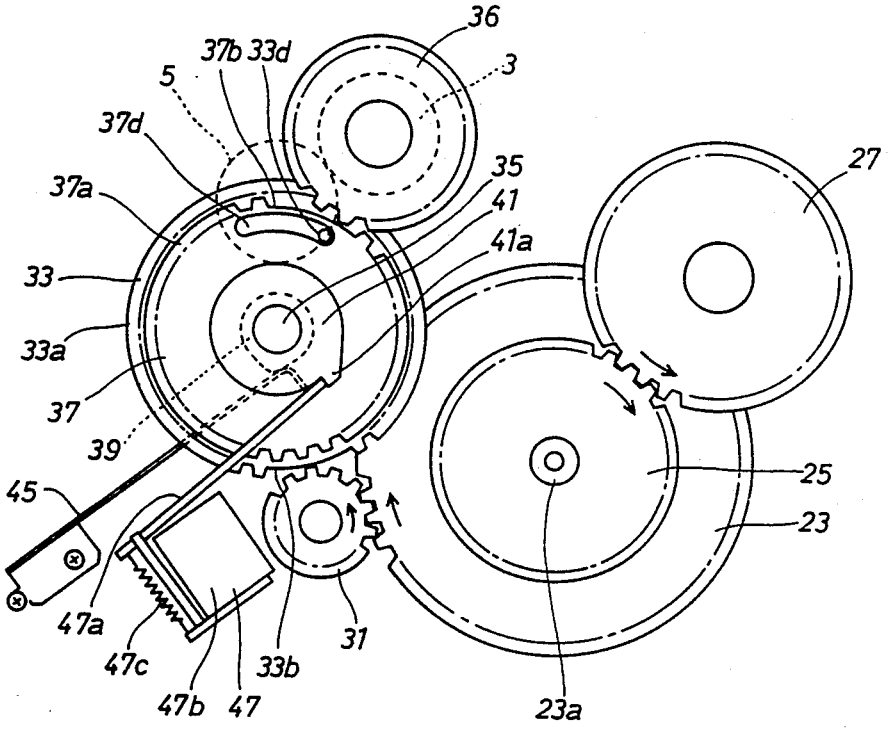
FIGS. 1, 4A and 4B are front views of an intermittent mechanism of a paper feeding apparatus for a printer embodying the present invention.

Referring to FIG. 1, the intermittent mechanism 30 will now be explained. A driving gear 31, connected directly with the stepping motor 21, always engages with a first driven gear 23. A shaft 23*a* of the first driven gear 23 is fixed with a second driven gear 25 which is operated in accordance with the first driven gear 23. The second driven gear 25 always engages with a platen gear 27.

Figure 3:
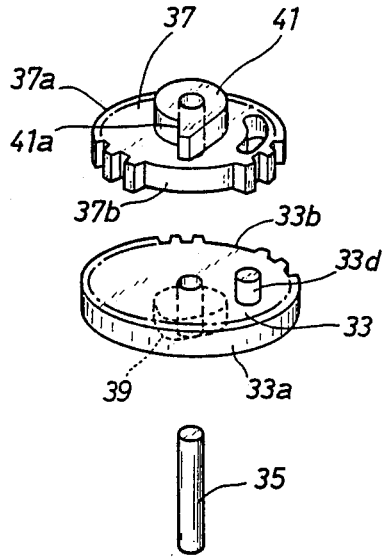
FIG. 3 is an exploded perspective view illustrating a main portion of the intermittent mechanism.

A first intermittent gear 33 is disposed opposite to the driving gear 31. The first intermittent gear 33 has a gear portion 33*a* and a toothless portion 33*b*. The gear portion 33*a* is provided to engage with the driving gear 31 while the toothless portion 33*b* does not engage therewith. FIG. 1 illustrates the first intermittent gear 33 with the toothless portion 33*b* opposite to the driving gear 31. A shaft 35 in the center of the first intermittent gear 33 supports a second intermittent gear 37, a press cam 39, and a stop cam 41. The second intermittent gear 37 comprises a gear portion 37*a* and a toothless portion 37*b*. The gear portion 37*a* is provided to engage with a paper feed gear 36 while the toothless portion 37*b* does not engage therewith. The first intermittent gear 33 is formed integrally with the press cam 39, while the second intermittent gear 37 is formed integrally with the stop cam 41. The first and second intermittent gears 33 and 37 are rotatably supported on the shaft 35. As shown in FIG. 3, a pin 33*d* is formed on the side surface of the first intermittent gear 33. The pin 33*d* is inserted into a slot 37*d* on the second intermittent gear 37 so as to be slid along the slot 37*d*.

Referring again to FIG. 1, an end portion of a plate spring 45 presses the press cam 39 to rotate it clockwise in the drawing. A working rod 47*a* of an electromagnetic device 47 is disposed with its end connected with a projecting portion 41*a* of the stop cam 41. The electromagnetic device 47 energizes a solenoid 47*b* to pull the working rod 47*a* against a spring 47c.

Now, a paper feed mechanism will be explained in detail with reference to FIGS. 1, 4A and 4B.

First, FIG. 1 illustrates a way of rotating the platen 9 forward while suspending the paper feed roller 3. When the solenoid 47*b* of the electromagnetic device 47 is not energized, the working rod 47*a* abuts on the projecting portion 41*a* of the stop cam 41 by means of the spring force of the spring 47*c*. Since the driving gear 31 engages with the first driven gear 23 in this case, the rotational motion is transmitted from the driving gear 31 to the platen gear 27 via the first driven gear 23, the shaft 23*a* and the second driven gear 25. As a result, the platen 9 is rotated forward, i.e., counterclockwise in the drawing. On the other hand, since the driving gear 31 is opposite to the toothless portion 33*b* of the first intermittent gear 33, the driving motion is not transmitted to the first intermittent gear 33. Similarly, since the paper feed gear 36 is opposite to the toothless portion 37*b* of the second intermittent gear 37, the rotational motion is not transmitted to the paper feed roller 3.

Figure 4A:
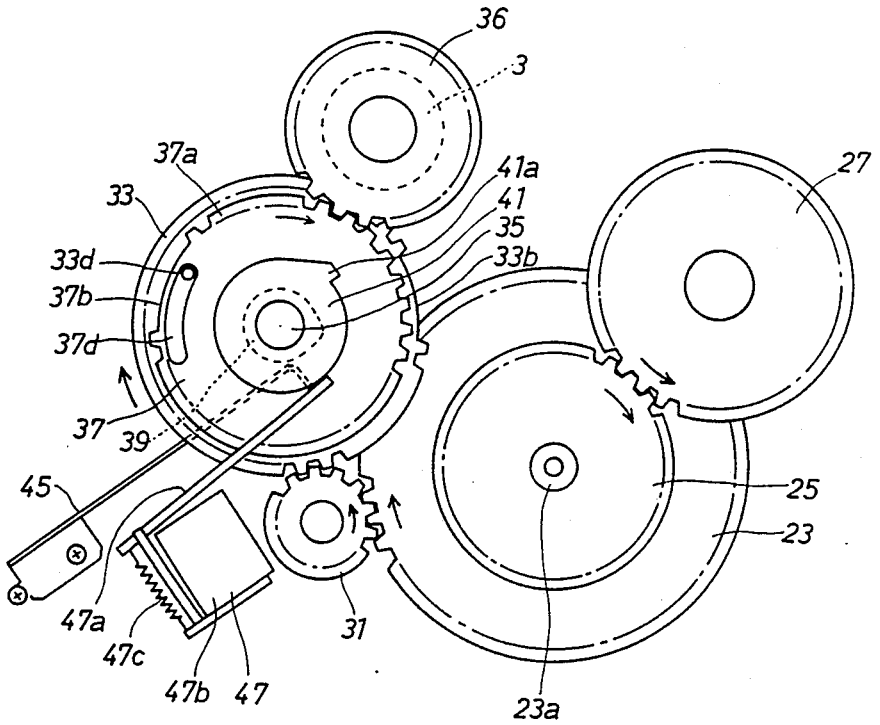

Second, FIG. 4A illustrates a way of rotating the platen 9 and the paper feed roller 3 forward. When the solenoid 47*b* of the electromagnetic device 47 is energized, the working rod 47*a* is pulled away from the projecting portion 41*a* of the stop cam 41 so as to rotate the press cam 39 clockwise from the end of the plate spring 45. The rotation of the press cam 39 accordingly rotates the first intermittent gear 33 clockwise around the shaft 35, resulting in the engagement of the gear portion 33*a* of the first intermittent gear 33 with the driving gear 31. Thereafter, the rotation of the first intermittent gear 33 is transmitted to the second intermittent gear 37 via the pin 33*d* and one end portion of the slot 37*d* so as to rotate the second intermittent gear 37 clockwise. Thus, the second intermittent gear 37 engages with the paper feed gear 36. Thereafter, the working rod 47*a* is connected with the projecting portion 41*a* again by means of the spring force of the spring 47*c*, as shown in FIG. 1.

In the same way as described in the first case with reference to FIG. 1, the forward rotation of the stepping motor 21, in this second case, also rotates the platen 9 forward via the driving gear 31, the first driven gear 23, the shaft 23*a*, the second driven gear 25 and the platen gear 27. Furthermore, the rotation of the stepping motor 21 rotates the paper feed roller 3 forward, i.e., counterclockwise in the drawing, via the driving gear 31, the first intermittent gear 33, the pin 33*d*, the end portion of the slot 37*d*, the second intermittent gear 37 and the paper feed gear 36.

Figure 4B:
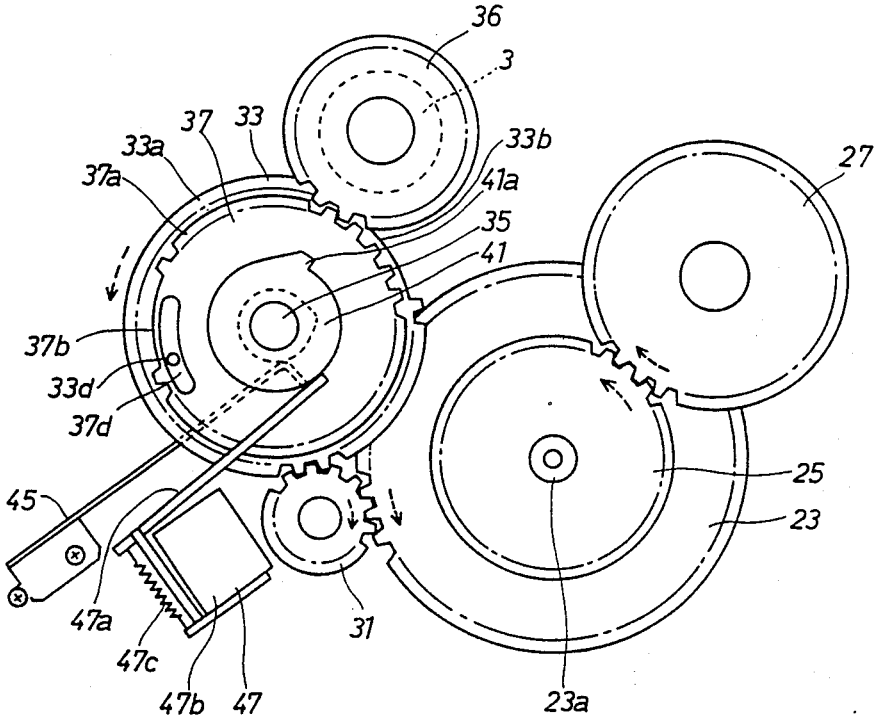

Third, FIG. 4B illustrates a way of rotating only the platen 9 backward while suspending the paper feed roller 3. When the stepping motor 21 is rotated backward so as to rotate the driving gear 31 clockwise in the drawing, the rotational motion is transmitted from the first driven gear 23 to the platen gear 27 via the shaft 23*a* and the second driven gear 25 so as to rotate the platen 9 backward, i.e., clockwise.

While the backward rotation of the driving gear 31 rotates the first intermittent gear 33 counterclockwise, the pin 33d on the first intermittent gear 33 moves in the slot 37*d* on the second intermittent gear 37. Therefore, the rotational motion of the first intermittent gear 33 is not transmitted to the second intermittent gear 37, and accordingly neither the paper feed gear 36 nor the paper feed roller 3 rotates.

As described above, a predetermined amount of the backward rotation of the stepping motor 21 rotates the platen 9 backward and simultaneously suspends the paper feed roller 3. Moreover, if the stepping motor 21 is rotated backward for more than the predetermined amount, the pin 33*d* on the first intermittent gear 37 abuts on one end portion of the slot 37*d* on the second intermittent gear 37. As a result, the rotational motion is transmitted from the driving gear 31 to the paper feed gear 36 simultaneously with the platen gear 27, and thus the paper feed roller 3 is rotated together with the platen 9 backward, i.e., clockwise in the drawing.

When the stepping motor 21 is rotated forward again, the working rod 47*a* of the electromagnetic device 47, which is now de-energized, abuts on the projecting portion 41*a* of the stop cam 41 at its end. Thus, the toothless portion 33*b* of the first intermittent gear 33 is disposed opposite to the driving gear 31, keeping the first intermittent gear 33 in neutral.

Hereinafter, a paper feed operation of the present invention will be explained with reference to the flowcharts in FIGS. 5A and 5B. The routine begins with the intermittent mechanism in neutral as shown in FIG. 1. The solenoid 47*b* of the electromagnetic device 47 is energized in STEP 101. Then, the working rod 47*a* is released from the projecting portion 41*a* so that the plate spring 45 presses the press cam 39 and rotates the first intermittent gear 33 together with the second intermittent gear 37 clockwise in FIG. 1. As a result, the driving gear 31 engages with the gear portion 33*a* of the first intermittent gear 33 while the paper feed gear 36 engages with the gear portion 37*a* of the second intermittent gear 37. After STEP 102 waits for 50 msec, STEP 103 de-energizes the solenoid 47*b* with the result that the working rod 47*a* returns to its initial position due to the spring 47*c*, as shown in FIG. 4A.

In STEP 104 the stepping motor 21 is rotated forward for 132 steps, one step being determined to feed a sheet for 1/48 inch. The driving gear 31 is then rotated forward as shown by an arrow in FIG. 4A. In response to the rotation of the driving gear 31, the paper feed roller 3 is rotated via the first intermittent gear 33, the second intermittent gear 37, and the paper feed gear 36. The rotated paper feed roller 3 and the brake roller 5 work together to advance a sheet of paper 2 from the paper feed tray 1 toward the platen 9. On the other hand, the platen 9, in response to the rotation of the driving gear 31, is rotated forward via the first driven gear 23, the second driven gear 25, and the platen gear 27. The platen 9 accordingly advances the sheet 2 whose leading edge is already advanced to a position between the rear paper guide roller 11 and the platen 9 by the paper feed roller 3 and the brake roller 5. Thereafter, when the rotation of the stepping motor 21 stops, the paper feeding action ceases with the leading edge of the sheet 2 set adjacent to the paper detective sensor 14.

If the stepping motor 21 is further rotated in STEP 104, the toothless portion 33b and 37b of the intermittent gears 33 and 37 would be positioned again opposite to the driving gear 31 and the paper feed gear 6. Thus, the rotation of the driving gear 31 would not be transmitted to the paper feed gear 36, wherein the rotation of the paper feed roller 3 would be suspended. Simultaneously, the projecting portion 41*a* of the stop cam 41 would abut on the working rod 47*a* so as to set the intermittent gears 33 and 37 in the initial state, namely, in neutral as shown in FIG. 1.

After STEP 104, STEP 105 rotates the stepping motor 21 backward as much as 25 steps in order to arrange the leading edge of the sheet 2 properly along the platen's longitudinal direction. At this stage, the first intermittent gear 33 is engaging with the driving gear 31 and the second intermittent gear 37 is engaging with the paper feed gear 36. In response to the backward rotation of the stepping motor 21 shown by the interrupted arrow in FIG. 4B, the first intermittent gear 33 is rotated counterclockwise as shown by the interrupted arrow. Simultaneously, the pin 33*d* on the first intermittent gear 33 moves in the slot 37*d* on the second intermittent gear 37. Therefore, the rotational motion of the first intermittent gear 33 is not transmitted to the second intermittent gear 37, and accordingly the paper feed roller 3 is prevented from rotation. In contrast, the platen 9 is rotated backward via the first driven gear 23, the second driven gear 25 and the platen gear 27. As a result, the sheet 2 which has been advanced to the platen 9 is rewound and bent off from the paper path preferably. The stepping motor 21 is rotated backward 20 steps with the result that the pin 33*d* abuts on one end portion of the slot 37*d* to rotate the second intermittent gear 37 backward 5 steps together with the first intermittent gear 33. As a result, the paper feed roller 3 is rotated backward via the paper feed gear 36.

In the subsequent STEP 106, the stepping motor 21 is rotated forward as much as one step so as to feed the sheet 2 for 1/48 inch. STEP 107 determines whether the detective sensor 14 detects a leading edge of the sheet 2. STEP 108 determines whether the stepping motor 21 is already rotated for 144 steps so as to feed the sheet 2 for three inches. When the decision in STEP 108 is NO, the program returns to STEP 106 to repeat the loop of STEPs 106–108.

When the decision in STEP 107 is YES, i.e., when the paper detective sensor 14 detects the leading edge of the sheet 2, the program jumps to STEP 120 where the print head 15 is moved to its initial position for printing, and then to STEP 121 where the sheet 2 is advanced until a border of a preset top margin of the sheet 2 is opposite to the print head 15. More specifically, the sheet 2 is advanced as much as the top margin in addition to a distance between a printing position on the platen 9 and the detective sensor 14.

When the decision in STEP 108 is YES, i.e., when the sheet 2 does not reach the platen 9 yet even after the driving gear 31 makes more than one rotation so as to advance the sheet 2 for three inches, the program proceeds to STEP 109, STEP 110, and STEP 111 where the same manipulation is given as in STEP 101, STEP 102, and STEP 103. As a result, the first and second intermittent gears 33 and 37 engage with the driving gear 31 and the paper feed gear 36 respectively. STEP 112, STEP 113 and STEP 114 repeat the same operations as in STEP 106, STEP 107 and STEP 108. To elaborate, STEP 112 continuously rotates the stepping motor 21 as much as one step so as to advance the leading edge of the sheet 2 for 1/48 inch, and STEP 113 determines whether the sheet 2 is detected by the detective sensor 14 or not. If the decision in STEP 114 is YES, i.e., if the sheet 2 is not detected even after the stepping motor 21 is rotated for 144 steps in order to feed the sheet 2 for three inches, the program jumps to STEP 119 where an error sign is displayed on a display device (not shown).

If the leading edge of the sheet 2 is detected in STEP 113, the program proceeds to STEP 115 where the stepping motor 21 is rotated backward so as to move the sheet 2 backward in the following manner, which is similar to STEP 105. Now, the driving gear 31 and the paper feed gear 36 engage with the gear portions 33*a* and 37*a* of the intermittent gears 33 and 37 if the leading edge of the sheet 2 is detected before the intermittent gears 33 and 37 make one rotation in STEP 112. When STEP 115 moves the sheet 2 backward in this condition, the first intermittent gear 33 is rotated counterclockwise in the drawing as shown by an interrupted arrow in FIG. 4B. Simultaneously, the pin 33*d* on the first intermittent gear 33 moves in the slot 37*d* on the second intermittent gear 37. Therefore, the rotational motion of the first intermittent gear 33 is not transmitted to the second intermittent gear 37, and accordingly the paper feed roller 3 is prevented from rotation. In contrast, the platen 9 is rotated backward via the first driven gear 23, the second driven gear 25 and the platen gear 27. As a result, the sheet 2 which has been advanced to the platen 9 is rewound and bent off from the paper path preferably. Thereafter, the stepping motor 21 is rotated backward another 20 steps with the result that the pin 33*d* abuts on one end portion of the slot 37*d* to rotate the second intermittent gear 37 backward together with the first intermittent gear 33. As a result, the paper feed roller 3 is rotated backward via the paper feed gear 36. This backward rotation of the paper feed roller 3 prevents the sheet 2 from being bent more than required, thereby preventing the sheet 2 from being wrinkled. Due to the tension caused in the sheet 2 which has been bent as described above, the sheet can be reset and held between the platen 9 and the rear paper guide roller 11. More specifically, the leading edge of the sheet 2 can be set in parallel with the axes of the platen 9 and the rear paper guide roller 11, thereby preventing the sheet 2 from skewing.

The subsequent STEP 116, STEP 117, and STEP 118 repeat the same operations as in STEP 106, STEP 107 and STEP 108 again. To elaborate, STEP 116 rotates the stepping motor 21 forward in order to rotate the first intermittent gear 33 clockwise in FIG. 4A on condition that the gear portions 33*a* and 37*a* of the intermittent gears 33 and 37 engage with the driving gear 31 and the paper feed gear 36, respectively. Under such conditions, the second intermittent gear 37 remains in the same position because the pin 33d on the first intermittent gear 33 moves in the slot 37*d* on the second intermittent gear 37 to reach the opposite end of the slot 37*d* to that in STEP 115. Therefore, the paper feed roller 3 is free from backward rotation, so that the platen 9 feeds the sheet 2 properly. When STEP 116 rotates the stepping motor 21 forward with the toothless portions 33*b* and 37*b* disposed opposite to the driving gear 31 and the paper feed gear 36, the paper feed roller 3 is naturally free from backward rotation, resulting in the proper paper feed by the platen 9.

If the decision in STEP 118 is YES, i.e., if the sheet 2 is not detected by the detective sensor 14 even after the stepping motor 21 is rotated as much as to feed the sheet 2 for three inches in STEP 116, STEP 119 displays an error sign. If the sheet 2 is detected in STEP 117, on the other hand, STEP 120 and STEP 121 prepare the sheet 2 for printing.

According to the embodiment described above, the stepping motor 21 is rotated for a predetermined period, e.g., for feeding the sheet 2 for three inches in this embodiment, in STEP 106, STEP 107 and STEP 108. If the leading edge of the sheet 2 is detected during this predetermined period, the paper feed operation stops for a moment. If the sheet 2 is not detected, on the other hand, STEP 112, STEP 113 and STEP 114 repeat the paper feed operation. Moreover, the sheet 2 is not detected even after the paper feed operation in STEP 112, STEP 113 and STEP 114, then, STEP 116, STEP 117 and STEP 118 repeat the paper feed operation again. As a result, the first embodiment can considerably decrease the frequency in imperfect paper feed to the printing mechanism, and make it easier to handle the whole apparatus by saving a lot of trouble, e.g., of checking the condition of sheets set on the paper feed tray 1 on every occasion of imperfect paper feed.

Although the paper feed operation is repeated twice in the above embodiment, it may be repeated more than twice.

Figure 5A:
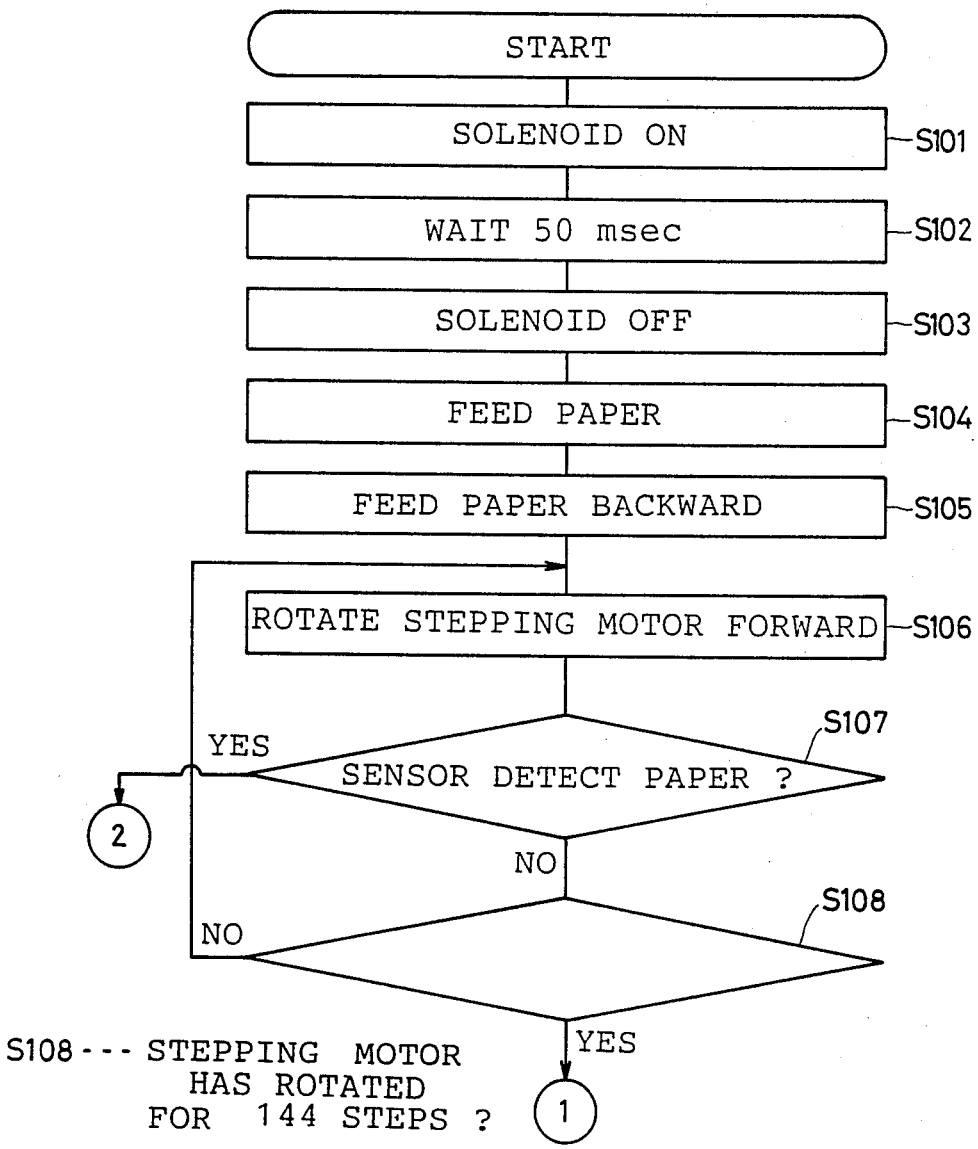
FIGS. 5A and 5B are flowcharts for explaining the first embodiment of the present invention.
Figure 5B:
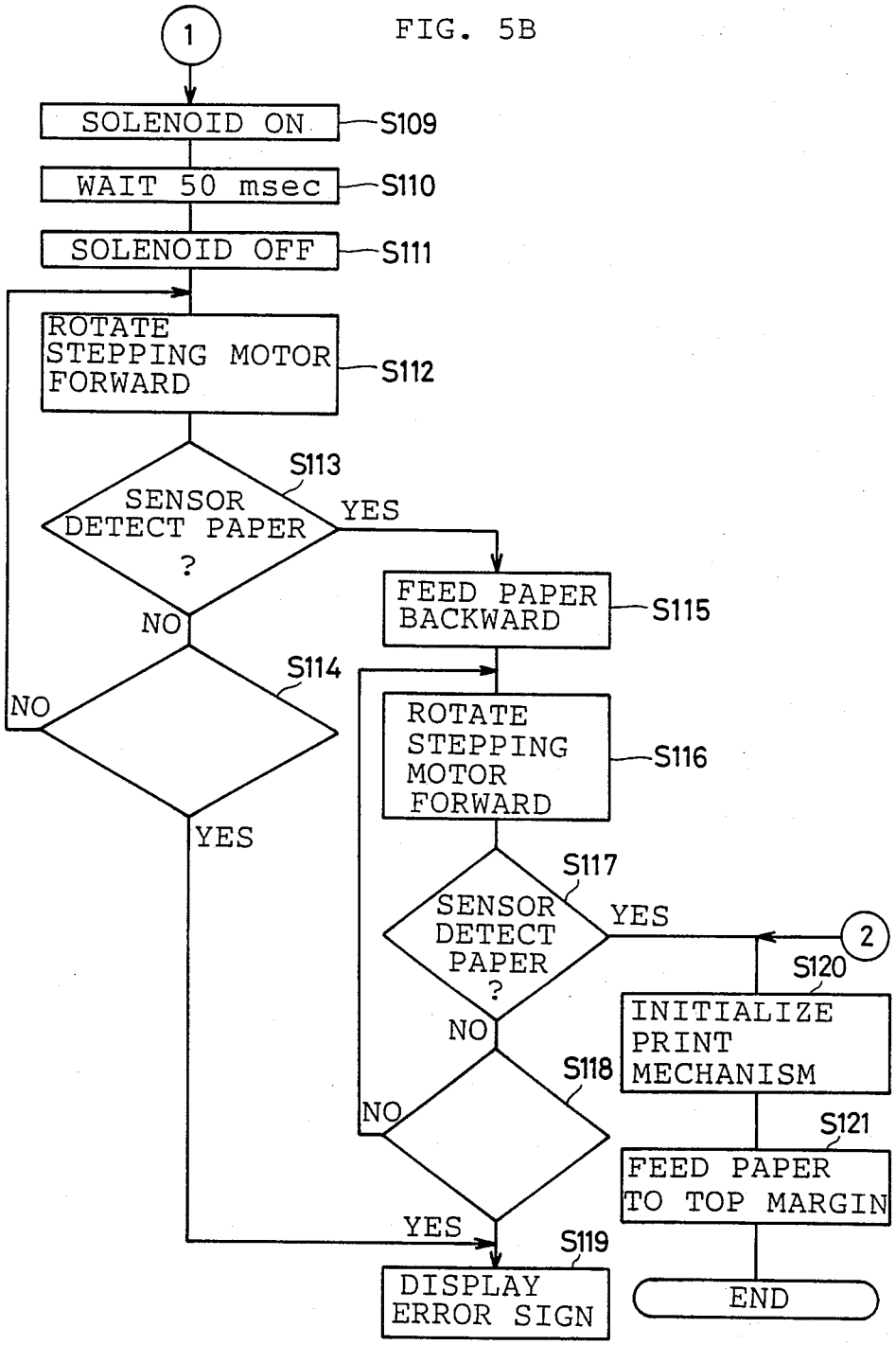
Figure 6:
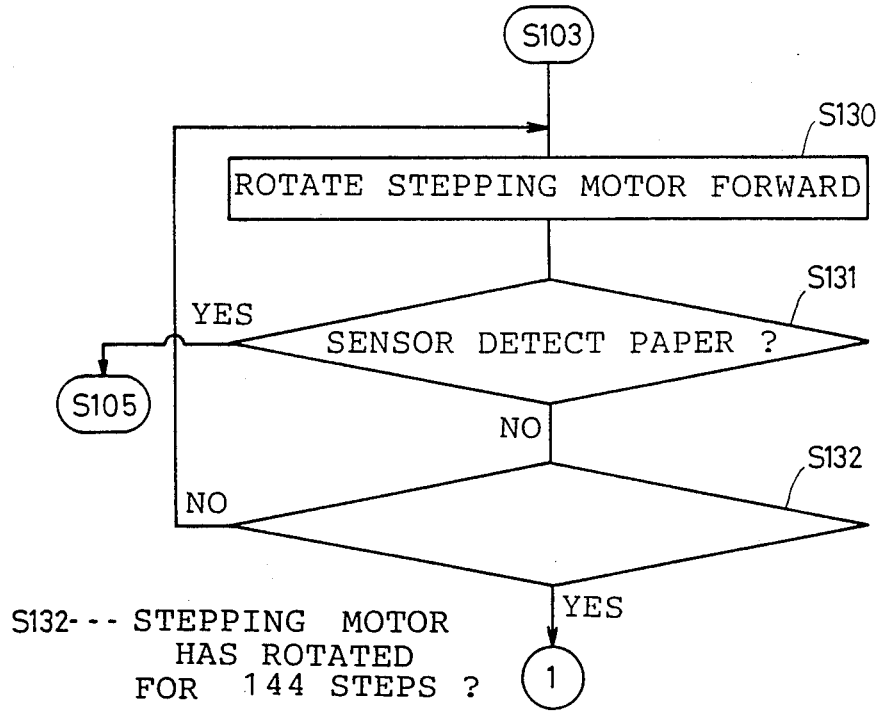
FIG. 6 is a part of the flowchart for explaining the second embodiment of the present invention.

As a second embodiment of the present invention, FIG. 6 shows a partial flowchart wherein the same actions as those executed from STEP 106 TO STEP 108 in FIG. 5A are executed instead of STEP 104. More particularly, STEP 103 in FIG. 5A is followed by a loop made of: STEP 130 where the stepping motor 21 is rotated forward for one step so as to feed the sheet 2 for 1/48 inch; STEP 131 where it is determined whether the detective sensor 14 detects a leading edge of the sheet; and STEP 132 where it is determined whether the stepping motor 21 is already rotated for 144 steps so as to feed the sheet 2 for three inches. When the decision in STEP 131 is YES, the program jumps to STEP 105 in FIG. 5A, and when it is NO, on the other hand, the program proceeds to STEP 132. When the decision in STEP 132 is YES, i.e., when the sheet 2 does not reach the platen 9 even after it has been advanced for three inches, the program proceeds to STEP 109 in FIG. 5B so as to repeat the paper feeding action. According to this second embodiment, it is possible to determine whether the sheet 2 has been precisely arranged between the platen 9 and the rollers 11 by means of the paper detective sensor 14. Therefore, the backward paper feeding action, executed in STEP 105 in FIG. 5A and STEP 115 in FIG. 5B, is effective in preventing the sheet 2 from skewing.

As many apparently widely different embodiments of this invention may be made without departing from the spirit and scope thereof, it is to be understood that the invention is not limited to the specific embodiments thereof except as defined in the appended claims.

What is claimed is:

1. A sheet-feeding control device for a printer comprising:

a printing mechanism including a platen and a printhead opposite said platen for printing on a sheet on said platen;

a tray for holding a pile of said sheets thereon;

a feed roller provided at an edge portion of said tray to rotate in a forward direction and to contact said sheets on said tray and sequentially feed a top sheet of said sheets to said printing mechanism;

a drive mechanism for rotating said feed roller and said platen;

detection means opposite said platen for detecting that said sheet has reached a predetermined position of a sheet path between said tray and said printhead and generating a signal representative thereof;

a first forward-feeding means for activating said drive mechanism to cause a forward-feeding action of said platen during a predetermined time period and for stopping said forward-feeding action when said detection means sends said detection signal; and a second forward-feeding means for activating said drive mechanism to automatically repeat said forward-feeding action when said detection means sends no detection signal during said predetermined time period of said first forward-feeding means.

2. The sheet-feeding control device for the printer according to claim 1, wherein said drive mechanism has gear means that rotates for a predetermined distance during said predetermined time period to feed said sheet, said gear means having a non-driving portion that stops said feed said feeding action.

3. A sheet-feeding control device for a printer comprising:

a printing mechanism including a platen and a printhead opposite said platen for printing on a sheet on said platen;

a tray for holding a pile of said sheets thereon;

a feed roller provided at an edge portion of said tray to rotate in a forward direction and to contact said sheets on said tray and sequentially feed a top sheet of said sheets to said printing mechanism;

a drive mechanism for rotating said feed roller and said platen;

detection means opposite said platen for detecting that said sheet has reached a predetermined position of a sheet path between said tray and said printhead and generating a signal representative thereof;

an initial forward-feeding means for activating said drive mechanism to cause an initial forward-feeding action of said feed roller and said platen;

a first backward-feeding means responsive to said initial forward-feeding means for activating said drive mechanism to cause a backward-feeding action of at least said platen to prevent misfeeding of said sheet;

a first forward-feeding means responsive to said first backward-feeding means for activating said drive mechanism to cause a forward-feeding action of said platen;

a second forward-feeding means for activating said drive mechanism to automatically repeat said forward-feeding action when said first forward-feeding means completes said forward-feeding action and said detection means sends no detection signal; and a second backward-feeding means responsive to said second forward-feeding means for activating said drive mechanism to automatically repeat said backward-feeding action to prevent misfeeding of said sheet when said detection means sends said detection signal.

4. The sheet-feeding control device for the printer according to claim 3, wherein said first and second forward-feeding means each includes means for advancing said sheet to said predetermined position opposite said printhead when said detection means sends said detection signal.

5. The sheet-feeding device for the printer according to claim 3, wherein said first and second forward-feeding means each includes means for determining if said detection means has sent said detection signal.

6. The sheet-feeding device for the printer according to claim 3, wherein said second forward-feeding means includes means for displaying an error sign when said detection means sends no detection signal even after said second forward-feeding action is completed.

* * * * *